United States Patent [19]

Hayes

[11] Patent Number: 4,547,128

[45] Date of Patent: Oct. 15, 1985

[54] PROPORTIONAL MIXING MEANS

[76] Inventor: John W. Hayes, 111 Colonial Dr., Cleveland, Miss. 38732

[21] Appl. No.: 607,973

[22] Filed: May 7, 1984

[51] Int. Cl.[4] ..... F04B 41/06; F04B 49/00; B67D 5/52

[52] U.S. Cl. ..... 417/2; 417/38; 417/429; 137/566; 222/135; 222/145

[58] Field of Search ..... 417/2–8, 417/426–429, 216, 38, 247, 85, 87, 286, 287; 137/566, 99; 222/133, 135, 145

[56] References Cited

U.S. PATENT DOCUMENTS

| | | | |
|---|---|---|---|
| 2,601,018 | 6/1952 | Heyl et al. | 417/426 |
| 2,724,581 | 11/1955 | Pahl et al. | 417/429 X |
| 2,903,248 | 9/1959 | Walker | 417/426 X |
| 2,968,915 | 1/1961 | Feistel, Jr. | 417/429 X |
| 3,081,909 | 3/1963 | Hooker | 222/135 X |
| 3,097,764 | 7/1963 | Loeser | 222/135 X |
| 3,223,040 | 12/1965 | Dinkelkamp | 417/3 |
| 3,316,844 | 5/1967 | Valk et al. | 417/2 |
| 3,359,910 | 12/1967 | Latham, Jr. | 417/426 |
| 3,504,686 | 4/1970 | Cooper et al. | 137/568 X |
| 3,584,977 | 6/1971 | Coleman et al. | 417/2 X |
| 3,754,735 | 8/1973 | Hoyle et al. | 137/566 X |
| 3,817,658 | 6/1974 | Murase | 417/2 |
| 4,173,296 | 11/1979 | Marshall | 222/133 X |
| 4,186,769 | 2/1980 | Buyce | 417/5 X |
| 4,234,044 | 11/1980 | Hollan et al. | 137/99 X |
| 4,419,056 | 12/1983 | Ege | 417/426 |
| 4,422,830 | 12/1983 | Perkins | 417/87 X |

FOREIGN PATENT DOCUMENTS

| | | | |
|---|---|---|---|
| 2025442 | 1/1980 | United Kingdom | 222/135 |

*Primary Examiner*—William L. Freeh
*Assistant Examiner*—Paul F. Neils
*Attorney, Agent, or Firm*—Walker & McKenzie, P.C.

[57] ABSTRACT

A proportional mixing unit for accurately metering the desired amounts of a liquid concentrate and a liquid diluent, completely mixing the concentrate and diluent together, and holding the mixture until needed. A constant volume pump is used to pump a constant volume of the liquid concentrate. A pressure regulator maintains the liquid diluent at a constant pressure. A variable volume pump is used to mix the liquid concentrate from the constant volume pump and the liquid diluent from the pressure regulator and to pump a variable volume of the mixture to a holding tank. By varying the volume of the variable volume pump, the proportion of liqiuid concentrate to liquid diluent is accurately varied.

4 Claims, 3 Drawing Figures

PROPORTIONAL MIXING MEANS

BACKGROUND OF THE INVENTION

1. Field of the Invention

The present invention relates, in general, to means and systems for mixing a liquid concentrate and a liquid diluent to form a liquid dilution of desired proportions and for delivering the dilution to one or more work stations.

2. Description of the Prior Art

Heretofore, various liquid proportioning systems have been developed. See, for example, Pahl, U.S. Pat. No. 2,724,581; Cooper, U.S. Pat. No. 3,504,686; and Buyce, U.S. Pat. No. 4,186,769. None of the above patents disclose or suggest the present invention.

The Buyce patent discloses an apparatus which includes, in general, a conduit extending from a source of liquid diluent, (e.g., water) to one or more work stations, a metering pump for pumping a specific amount of liquid concentrate from a source thereof to the conduit, a primary pump for receiving and mixing the liquid diluent from the source thereof and the liquid concentrate from the metering pump, and an accumulator for receiving and storing the mixed dilutions from the primary pump.

SUMMARY OF THE INVENTION

The present invention is directed toward improving prior means for mixing a liquid concentrate and liquid diluent. The concept of the present invention is to direct liquid diluent at a constant pressure and a constant volume of liquid concentrate to a variable volume pump for mixing the diluent and concentrate.

The proportional mixing means of the present invention comprises, in general, a pressure regulator means for maintaining the pressure of a liquid diluent from a pressurized liquid diluent source at a constant pressure; a constant volume pump means for pumping a constant volume of liquid concentrate from a liquid concentrate source; a variable volume pump means for receiving the liquid diluent from the pressure regulator means and for receiving the liquid concentrate from the constant volume pump means and for mixing the liquid diluent and liquid concentrate into a liquid dilution and for pumping a variable volume of the liquid dilutions; and holding tank means for receiving the liquid dilution from the variable volume pump means.

DESCRIPTION OF THE PREFERRED EMBODIMENT

Figure 1:
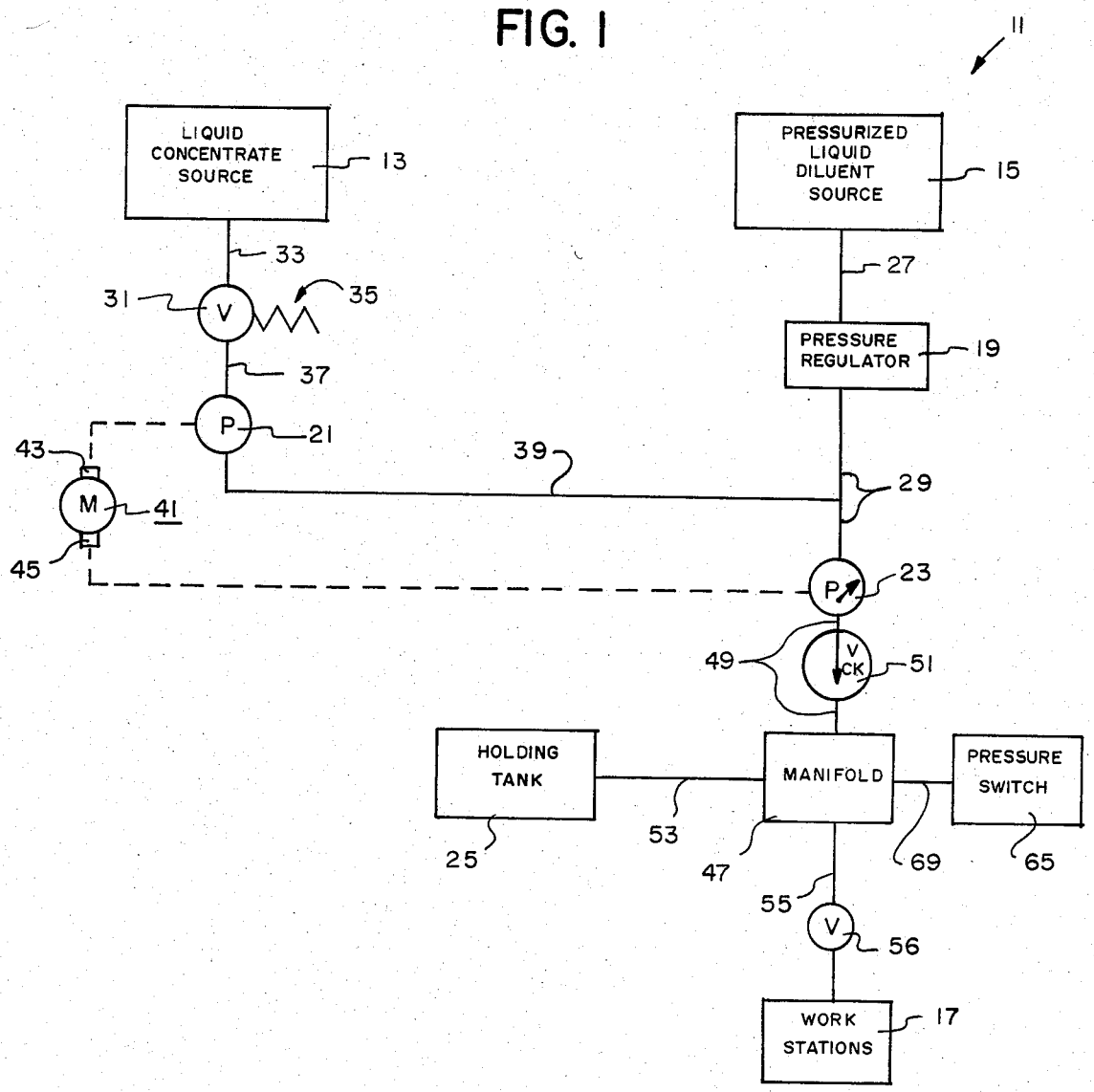
FIG. 1 is a schematic illustration of the proportional mixing means of the present invention.

The proportional mixing means 11 of the present invention is for use in mixing a liquid concentrate from a liquid concentrate source 13, such as an opened holding tank or the like, and a liquid diluent from a pressurized liquid diluent source 15, such as a pressurized holding tank or the like to form a liquid dilution of a desired proportion and for delivering the liquid dilution to one or more work stations 17. The proportional mixing means 11 includes, in general, a pressure regulator means 19, a constant volume pump means 21, a variable volume pump means 23, and a holding tank means 25.

The liquid concentrate may be of any type meant to be mixed with a liquid diluent in substantially exact proportions to form a liquid dilution. For example, the liquid concentrate may consist of a water soluble lubricant for being mixed with water to form a lubricating dilution for use in a central lubricating system or the like whereby the lubricating dilution is used at various work stations where various machining or die casting steps and the like may take place.

The liquid dilution may consist of any liquid for being mixed with the specific liquid concentrate. Thus, for example, the liquid dilution may consist simply of water and the pressurized liquid dilution source 15 may consist simply of a typical pressurized water supply system, etc., well known to those skilled in the art.

The pressure regulator means 19 is coupled to the pressurized liquid diluent source 15 in any manner apparent to those skilled in the art, such as by way of a conduit 27 or the like. The pressure regulator means 19 may consist of any typical pressure regulator well known to those skilled in the art for reducing the liquid pressure passing through the conduit 27 from the pressurized liquid diluent source 15 to a constant pressure. Thus, for example, the pressure of the liquid diluent from the pressurized liquid diluent source 15 may vary between, for example, forty to fifty pounds per square inch and the pressure regulator means 19 may reduce this pressure, for example, to a constant twenty pounds per square inch to make sure there is no pressure variation at the variable volume pump means 23 for reasons which will hereinafter become apparent.

The pressurized liquid may pass from the pressure regulator 19 to the variable volume pump 23 in any manner apparent to those skilled in the art, such as by way of the conduit 29.

The proportional mixing means 11 may include a liquid concentrate valve means 31 located between the constant volume pump means 21 and the liquid concentrate source 13 for selectively preventing the flow of liquid concentrate between the liquid concentrate source 13 and the constant volume pump means 21. Liquid concentrate may pass between the liquid concentrate source 13 and the valve means 31 in any manner apparent to those skilled in the art, such as by way of a conduit 33. The valve means 31 may be of any type apparent to those skilled in the art for movement between an opened position in which liquid is allowed to flow therethrough and a closed position in which liquid is prevented from flowing therethrough. The proportional mixing means 11 preferably includes typical solenoid means 35 for opening and closing the valve means 31 in a manner well known to those skilled in the art.

The liquid concentrate may pass from the valve means 31 to the constant volume pump means 21 in any manner apparent to those skilled in the art, such as by way of a conduit 37.

The constant volume pump means 21 may consist of a standard gear pump, such as the one-half gallon per minute model D-1 manufactured by Delta Power Hydraulic Company of Louisville, Ky. which displaces 0.00028 gallons per revolution at zero pounds per square inch and generates a constant flow of 0.49 gallons per minute at 1750 revolutions per minute, whereby liquid concentrate can be pumped from the liquid concentrate source 13 at a constant rate.

The liquid concentrate may pass from the constant volume means 21 to the variable volume pump means 23 in any manner apparent to those skilled in the art, such as by way of a conduit 39 extending from the constant volume pump means 21 to the conduit 29 between the pressure regulator means 19 and the variable volume pump means 23.

The variable volume pump means 23 may consist of a standard gear pump, such as the three gallon per minute model D-6 manufactured by Delta Power Hydraulic Company of Louisville, Ky. which displaces 0.00137 gallons per revolution at zero pounds per square inch. With this pump connected and driven by a variable revolution per minute drive shaft of a motor, the pump output varies proportionately with the shaft speed. Because the outlets of the constant volume pump means 21 and the pressure regulator means 19 are connected to the inlet of the variable volume pump means 23 via the conduit 29, proportioning and mixing are achieved by the variable volume pump means 23. Thus, for example, if the constant volume pump means 21 delivers 0.49 gallons per minute to the intake of the variable volume pump means 23 and if the variable volume pump means 23 is operating at a speed of 2,000 revolutions per minute, the proportion would equal 4.5:1 ratio of liquid diluent to liquid concentrate.

The proportional mixing means 11 preferably includes a motor means 41 for driving the constant volume pump means 21 and the variable volume pump means 23. The motor means 41 may consist of separate electrical motors or the like, one for driving the constant volume pump means 21 and one for driving the variable volume pump means 23. Preferably, the motor means 41 consists of a single electric motor having a first drive shaft 43 for being drivably coupled to the constant volume pump means 21 and having a second drive shaft 45 for being drivably coupled to the variable volume pump means 23. The first output shaft 43 has a constant speed while the second output shaft 45 has a variable speed whereby the constant volume pump means 21 can be driven at a constant speed while the variable volume pump means 23 can be driven at a variable speed. Such a motor means may consist of various constructions which will be apparent to those skilled in the art. One such unit is the "Vari-Drive" unit manufactured by U.S. Electrical Motors of Milford, Conn. A motor shaft extension 43 is added to the standard Vari-Drive unit for driving the constant volume pump means 21. The standard Vari-Drive unit contains only the drive shaft 45 which is speed adjustable from 705 to 4,230 revolutions per minute.

The proportional mixing means 11 preferably includes a manifold means 47 located between the variable volume pump means 23, the holding tank means 25 and the work stations 17 for directing the liquid dilution from the variable volume pump means 23 to the holding tank means 25 and the work stations 17. The liquid dilution may pass from the variable volume pump means 23 to the manifold means 47 in any manner apparent to those skilled in the art, such as by way of a conduit 49. A check valve means 51 is preferably located in the conduit 49 for preventing liquid dilution from passing from the holding tank means 25 through the manifold means 47 and back to the variable volume pump means 23 while allowing liquid dilution to pass from the variable volume pump means 23 through the conduit 49 and manifold means 47 to the holding tank means 25, etc. The check valve means 51 may consist of any typical check valve well known to those skilled in the art.

The liquid dilution may pass from the manifold means 47 to the holding tank means 25 in any manner apparent to those skilled in the art, such as by way of a conduit 53.

The liquid dilution may pass from the manifold means 47 to the work stations 17 in any manner apparent to those skilled in the art, such as by way of one or more conduits 55.

The manifold means 47 may be of any construction apparent to those skilled in the art. Thus, for example, the manifold means 47 may be of a metal construction having an internal passageway 57 including an inlet passageway 59 for receiving the conduit 49, a first outlet passageway 61 for receiving the conduit 53 and communicating with the inlet passageway 59, a second outlet passageway 63 for receiving the conduit 55 and for communicating with the inlet passageway 59 and first outlet passageway 61 whereby the liquid dilution entering the manifold means 47 through the conduit 49 will be divided between the first and second outlet passageways 61, 63 for passage to the holding tank means 25 and work stations 17.

The holding tank means 25 may be of any construction apparent to those skilled in the art. Thus, for example, the holding tank means 25 may consist simply of a typical hollow metal tank.

One or more manually controlled valves 56 may be located in the conduit 55 between the manifold means 47 and the various work stations 17 to allow the flow of liquid dilution to any work station 17 to be controlled. The valves 56 may be of any typical construction apparent to those skilled in the art.

The proportional mixing means 11 preferably includes a control means for activating and deactivating the constant volume pump means 21 and the variable volume pump means 23 in response to preselected conditions. The control means preferably includes a pressure switch means 65 for sensing the pressure of the liquid dilution within the holding tank means 25 and for deactivating the constant volume pump means 21 and the variable volume pump means 23 when the pressure of the liquid dilution within the holding tank means 25 is above a preselected pressure and for activating the constant volume pump means 21 and the variable volume pump means 23 when the pressure of the liquid dilution within the holding tank means 25 is below a preselected pressure. The pressure switch means 65 may be of any typical construction well known to those skilled in the art. The pressure switch means 65 is preferably coupled to the manifold means 47 in communication with the internal passageway 57 whereby the pressure switch means 65 monitors the pressure of the liquid dilution within the manifold means 47. Since the holding tank means 25 is coupled directly to the internal passageway of the manifold means 57, monitoring the pressure of the liquid dilution within the manifold means 47 also monitors the pressure of the liquid dilution within the holding tank means 25. The internal passageway 57 thus preferably includes a third outlet passageway 67 communicating with the inlet passageway 59 and the first and second outlet passageways 61, 63 to allow the pressure switch means 65 to be coupled thereto either directly or by means of a conduit 69 or the like, as will be apparent to those skilled in the art.

Figure 2:
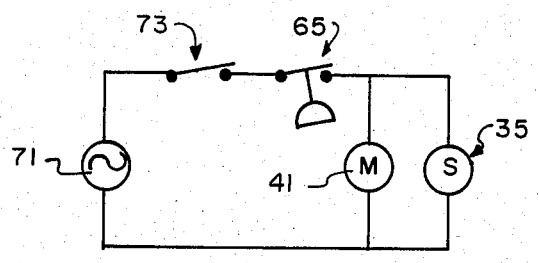
FIG. 2 is an electrical schematic of the electrical components of the proportional mixing means of the present invention.
Figure 3:
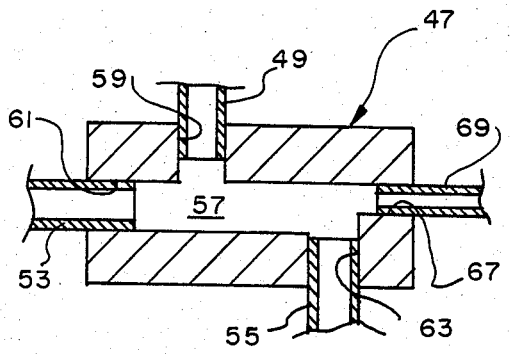
FIG. 3 is a sectional view of one element of the proportional mixing means of the present invention.

The pressure switch means 65 is preferably electrically coupled to the motor means 41 and the solenoid means 35 as shown in FIG. 2 whereby the pressure switch means 65 will control the passage of electrical energy from any typical source of electrical energy 71 to the motor means 41 and solenoid means 35. Thus, when the pressure of the liquid dilution within the manifold means 47 and, therefore, the holding tank means 25 is below a preselected pressure, the pressure switch means 65 will be closed thereby allowing electrical energy to pass from the source 71 thereof to the motor means 41 and solenoid means 35 whereby the motor means 41 will drive the constant volume pump means 21 and the variable volume pump means 23 and whereby the solenoid means 35 will cause the valve means 31 to remain open to allow liquid concentrate to pass from the liquid concentrate source 13 to the constant volume pump means 21. When the pressure of the liquid dilution within the holding tank means 25 and, therefore, the manifold means 47 is above a preselected pressure, the pressure switch means 65 will be opened thereby preventing electrical energy from passing from the source 71 thereof to the motor means 41 and solenoid means 35 whereby the pump means 21, 23 will be deactivated and the solenoid means 35 will allow the valve means 31 to close.

A typical manual switch 73 may be included in the electric circuitry between the source 71 of electrical energy, the pressure switch means 65, the solenoid means 35, and the motor means 41 for allowing the electric circuit to be manually broken.

The present invention allows extremely accurate control of the proportion of liquid concentrate to liquid diluent. Thus, the present invention maintains the amount of liquid concentrate at a constant amount while allowing the amount of liquid diluent to be varied by varying the volume of the variable volume pump means 23 (by varying the speed of the second drive shaft 45). Since a typical mixture may be sixty parts liquid diluent to one part liquid concentrate, the present invention allows the mixture to be fine tuned since it varies the amount of the liquid diluent which will allow the ratio to be changed by minute amounts. On the other hand, if the ratio were varied by changing the amount of liquid concentrate therein, a minute change in the amount of the liquid concentrate would cause a great change in the ratio.

Although the present invention has been described and illustrated with respect to a preferred embodiment thereof and a preferred use therefore, it is not to be so limited since changes and modifications can be made within the full intended scope of the invention.

I claim:

1. Proportional mixing means for mixing a liquid concentrate from a liquid concentrate source and a liquid diluent from a pressurized liquid diluent source to form a liquid dilution of a desired proportion and for delivering the liquid dilution to a work station, said mixing means comprising:

(a) pressure regulator means for maintaining the pressure of the liquid diluent at a constant pressure;

(b) constant volume pump means for pumping a constant volume of the liquid concentrate from the liquid concentrate source;

(c) variable volume pump means for receiving the liquid diluent from said pressure regulator means and for receiving the liquid concentrate from said constant volume pump means and for mixing the liquid diluent and liquid concentrate into a liquid dilution and for pumping a variable volume of the liquid dilution;

(d) holding tank means for receiving liquid dilution from said variable volume pump means;

(e) manifold means located between said variable volume pump means and said holding tank means for directing the liquid dilution from said variable volume pump means to said holding tank means and the work station;

(f) control means for activating and deactivating said constant volume pump means and said variable volume pump means in response to preselected conditions, said control means including a pressure switch means for sensing the pressure of the liquid dilution within said holding tank means and for deactivating said constant volume pump means and said variable volume pump means when the pressure of the liquid dilution within said holding tank means is above a preselected pressure and for activating said constant volume pump means and said variable volume pump means when the pressure of the liquid dilution within said holding tank means is below a preselected pressure; and (g) a liquid concentrate valve means located between said constant volume pump means and the liquid concentrate source for selectively preventing the flow of liquid concentrate between the liquid concentrate source and said constant volume pump means.

2. The mixing means of claim 1 in which said pressure switch means closes said liquid concentrate valve means when the pressure of the liquid dilution within said holding tank is above a preselected pressure and opens said liquid concentrate valve means when the pressure of the liquid dilution within said holding tank is below a preselected pressure.

3. The mixing means of claim 2 in which is included a check valve means for preventing liquid dilution from passing from said holding tank means to said variable volume pump means while allowing liquid dilution to pass from said variable volume pump means to said holding tank means.

4. The mixing means of claim 3 in which is included a motor means for driving said constant volume pump means and said variable volume pump means, said motor means including a first drive shaft for being drivably coupled to said constant volume pump means and including a second drive shaft for being drivably coupled to said variable volume pump means, said first drive shaft having a constant speed.

* * * * *